US007926928B2

(12) United States Patent
Umeda

(10) Patent No.: US 7,926,928 B2
(45) Date of Patent: Apr. 19, 2011

(54) DROPLET EJECTION APPARATUS AND INKJET RECORDING APPARATUS

(75) Inventor: Takaichiro Umeda, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 735 days.

(21) Appl. No.: 11/509,163

(22) Filed: Aug. 24, 2006

(65) Prior Publication Data

US 2007/0046744 A1 Mar. 1, 2007

(30) Foreign Application Priority Data

Aug. 24, 2005 (JP) ..... 2005-242774

(51) Int. Cl.
*B41J 2/175* (2006.01)

(52) U.S. Cl. ..... 347/87; 347/86

(58) Field of Classification Search ..... 347/87, 347/86, 31

See application file for complete search history.

(56) References Cited

U.S. PATENT DOCUMENTS

| | | | | |
|---|---|---|---|---|
| 5,631,681 | A * | 5/1997 | Klaus et al. | 347/85 |
| 6,055,002 | A * | 4/2000 | Wen et al. | 346/140.1 |
| 6,109,742 | A | 8/2000 | Higuma et al. | |
| 6,174,053 | B1 | 1/2001 | Higuma et al. | |
| 6,179,416 | B1 * | 1/2001 | Ikeda et al. | 347/86 |
| 6,224,200 | B1 | 5/2001 | Higuma et al. | |
| 6,325,498 | B1 | 12/2001 | Higuma et al. | |
| 6,382,786 | B2 * | 5/2002 | Iwanaga et al. | 347/86 |
| 2002/0060726 | A1 * | 5/2002 | Udagawa et al. | 347/93 |
| 2003/0052951 | A1 * | 3/2003 | Ujita et al. | 347/86 |
| 2004/0001126 | A1 * | 1/2004 | Oda et al. | 347/85 |

FOREIGN PATENT DOCUMENTS

| | | |
|---|---|---|
| JP | 6320747 | 11/1994 |
| JP | 8192518 | 7/1996 |

* cited by examiner

*Primary Examiner* — Stephen D Meier
*Assistant Examiner* — Sarah Al-Hashimi
(74) *Attorney, Agent, or Firm* — Frommer Lawrence & Haug LLP

(57) ABSTRACT

A droplet ejection apparatus includes: a head unit having at least one sub-tank that stores liquid, and an ejection head that ejects the liquid supplied from the sub-tank in a form of droplets; a head unit mover that moves the head unit; an absorber stored in the sub-tank, and made of a porous resilient member that absorbs the liquid; and a presser that compresses the absorber.

5 Claims, 15 Drawing Sheets

Y
C
M
Bk
C
Y
M
B
R
G
Pb
29
30
31
32
33
34
35
36
37
38
39
40
42

DROPLET EJECTION APPARATUS AND INKJET RECORDING APPARATUS

CROSS-REFERENCE TO RELATED APPLICATIONS

This application claims the benefit of Japanese Patent Application No. 2005-242774 filed Aug. 24, 2005 in the Japan Patent Office, the disclosure of which is incorporated herein by reference.

BACKGROUND

This invention relates to a droplet ejection apparatus that ejects liquid supplied from sub-tanks as droplets. Particularly, this invention is effective when applied to an inkjet recording apparatus (inkjet printer).

An ejection head of an inkjet recording apparatus or a droplet ejection apparatus ejects liquid, such as ink, in the form of droplets by use of a pressure means, such as piezo elements. When there are small holes, for example droplet ejection nozzles, on an ejection head, liquid which exists in the outlet of the droplet ejection nozzle becomes a dome-like shape and forms meniscus by the surface tension of the liquid.

Meanwhile, in a droplet ejection apparatus, when the ejection head is not in a state to eject droplets, that is, in a standby state wherein liquid is not pressed by the pressure means, such as piezo elements, liquid in the outlet of the droplet ejection nozzle should form meniscus curved toward inside of the droplet ejection nozzle by the surface tension of the liquid and the meniscus needs to be maintained in this shape.

However, since inside of the droplet ejection nozzle is filled with liquid, liquid in the droplet ejection nozzle usually tends to form meniscus projecting from the outlet of the droplet ejection nozzle due to the inner pressure (liquid pressure).

On the other hand, in a conventional inkjet recording apparatus, a porous absorber, which absorbs ink, is provided in a sub-tank. By an absorber aspirating liquid in the vicinity of the outlet of a droplet ejection nozzle, meniscus, curved toward inside of the droplet ejection nozzle, are maintained when the apparatus is in a standby state.

When droplets (ink) are ejected from an ejection head and consumed, liquid tends to move toward the ejection head. However, since liquid inside of a sub-tank is absorbed (impregnated) in an absorber and held therein, the liquid inside of a sub-tank cannot move freely as compared to a case wherein an absorber is not provided in a sub-tank.

Consequently, when droplets are ejected and ink (liquid) inside of a sub-tank is consumed, unevenness is caused in the amount of liquid held in different portions of an absorber, that is, in a portion of the absorber in vicinity of an ejection head and in a portion away from the ejection head.

When, for example, unevenness is caused, wherein large amount of liquid is held in a portion in vicinity of a liquid supply opening for replenishment, the absorber cannot reabsorb sufficient amount of liquid even when liquid is replenished (supplied) from the liquid supplying opening because large amount of liquid has been already absorbed (impregnated) in this portion of the absorber.

Therefore, in the above conventional inkjet recording apparatus, sufficient amount of ink (liquid) cannot be replenished, and the effectiveness in ink replenishment is low. The apparatus has a problem that ink inside of a sub-tank is consumed in a short time.

SUMMARY

In consideration of the above and other problems, one purpose of the present invention is to improve the effectiveness in liquid (for example, ink) replenishment, in a droplet ejection apparatus or an inkjet recording apparatus which includes an absorber inside of a sub-tank.

In one aspect of the present invention, a droplet ejection apparatus includes: a head unit having at least one sub-tank that stores liquid, and an ejection head that ejects the liquid supplied from the sub-tank in a form of droplets; a head unit mover that moves the head unit; an absorber stored in the sub-tank, and made of a porous resilient member that absorbs the liquid; and a presser that compresses the absorber.

Due to this configuration, the absorber can be compressed in a squashed manner by pressing the absorber with the presser. When the absorber is being pressed, liquid, if any liquid has already been absorbed (impregnated) in the absorber, is once discharged from the absorber.

When pressing by the presser is relieved, the absorber tends to expand (enlarge) to an original size because of restoring force (resilient force) of the absorber. By negative pressure generated inside of the absorber when the absorber expands, not only the liquid discharged when the absorber is compressed, but liquid existing around the absorber is also absorbed into the absorber.

Therefore, if the absorber is compressed in a squashed manner by pressing the absorber with the presser when liquid is replenished (supplied) into a sub-tank, liquid existing around the absorber can be reliably absorbed (impregnated) into the absorber when pressing by the presser is relieved and the absorber expands. As a result, the effectiveness in liquid replenishment can be improved.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

An embodiment of the present invention will now be described by way of example with the accompanying drawings.

In the present embodiment, an inkjet recording apparatus using a droplet ejection apparatus according to the present invention is applied to a so-called multifunction apparatus including a printer function, a scanner function, a copy function, and a facsimile function.

1. Overall Structure of Multi Function Apparatus 10

Figure 1:
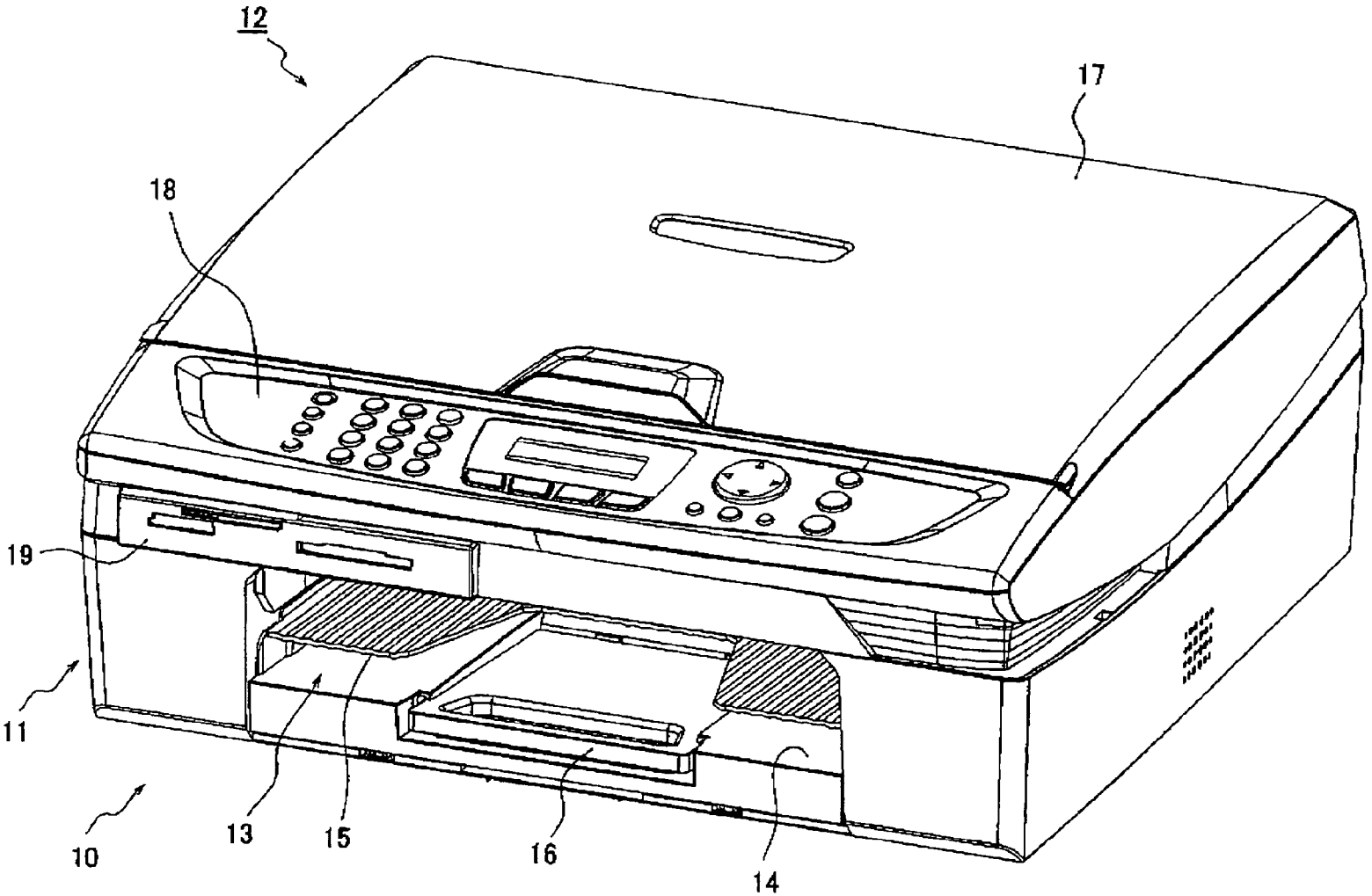
FIG. 1 is an external view of a multifunction apparatus according to an embodiment of the present invention.

Referring to FIG. 1, a multifunction apparatus 10 according to the present embodiment is provided with an inkjet printer unit 11 in the lower portion thereof, and a scanner unit 12 in the upper portion.

The printer unit 11 is provided with an opening 13, a paper feed tray 14, and a paper discharge tray 15. The opening 13 is disposed in the front surface of the printer unit 11. The paper feed tray 14 and the paper discharge tray 15 are disposed on top of another so as to be exposed from the opening 13. The paper feed tray 14 stores recording paper. Recording paper stored in the paper feed tray 14 is fed to the inside of the printer unit 11. A predetermined image is recorded on the recording paper. Then, the recording paper is discharged onto the paper discharge tray 15. The paper feed tray 14 is provided with a slide tray 16. The slide tray 16 is slid out, if necessary, so as to enlarge the tray surface.

The scanner unit 12 is composed as a so-called flat-bed scanner, and provided with a platen glass (not shown) and an image reading device (not shown) under a cover 17 which covers, from upside, an original to be read. The image reading device includes a CIS (Contact Image Sensor) and a CCD (Charge-Coupled Device). The platen glass is used so as to place an original thereon, The image reading device is disposed under the platen glass so as to be able to scan the entire surface of a placed original.

The multifunction apparatus 10 is furthermore provided with an operation panel 18, which is used so as to operate the printer unit 11 or the scanner unit 12. The operation panel 18 is provided with various operation buttons and a liquid crystal display unit. The multifunction apparatus 10 is operated according to an operation instruction from the operation panel 18 or an instruction sent from a computer via a printer driver.

2. Structure of Printer Unit 11 (Inkjet Recording Apparatus)

2.1 Overall Structure

Figure 2:
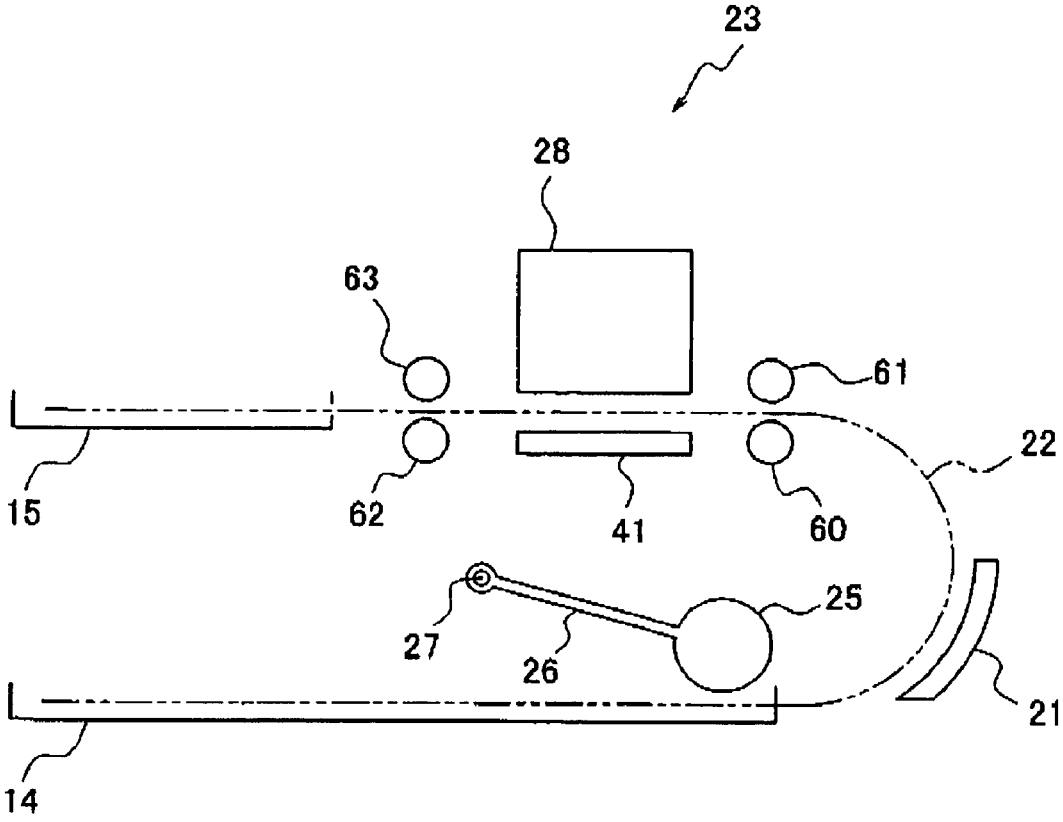
FIG. 2 is a diagram showing a structure of an inkjet recording apparatus according to the embodiment.

Referring now to FIG. 2, on the bottom of the multifunction apparatus 10 (printer unit 11), the paper feed tray 14 is disposed wherein a number of sheets of recording paper is placed. In the back side of the paper feed tray 14 (on the right side in the drawing), an inclined separation board 21 is provided so as to separate sheets of recording paper placed on the paper feed tray 14 and guide the recording paper toward the upside.

A conveyance path 22 of recording paper is formed upward from the inclined separation board 21. The conveyance path 22 is firstly extended upward, curved toward the left side in the drawing, furthermore extended from the back side of the multifunction apparatus 10 toward the front side thereof, and reaches the paper discharge tray 15 via an image recording unit 23. As a result, recording paper stored in the paper feed tray 14 is guided to the image recording unit 23 through the conveyance path 22 so as to make a U-turn from the lower side to the upper side. After an image is recorded on the recording paper by the image recording unit 23, the recording paper is discharged onto the paper discharge tray 15.

A paper feed roller 25 is provided so as to separate recording paper stacked on the paper feed tray 14 in a sheet-by-sheet manner and supply the recording paper a sheet by sheet to the conveyance path 22. The structure of the paper feed roller 25 is the same as that of a known paper feed roller.

That is to say, the paper feed roller 25 is, for example, supported on a leading end of a paper feed arm 26, which moves upward and downward, so that the paper feed roller 25 can be in contact with the paper feed tray 14 and separated therefrom. The paper feed roller 25 is connected to a motor via a drive transmission mechanism. The paper feed arm 26 is disposed so as to be rotatable around an axis 27 of the trailing end. The paper feed arm 26 is flipped upward by a paper feed clutch, a spring, or the like (not shown) when the printer unit 11 is in a standby state, and swung down when recording paper is fed.

2.2 Image Recording Unit 23

Figure 3:
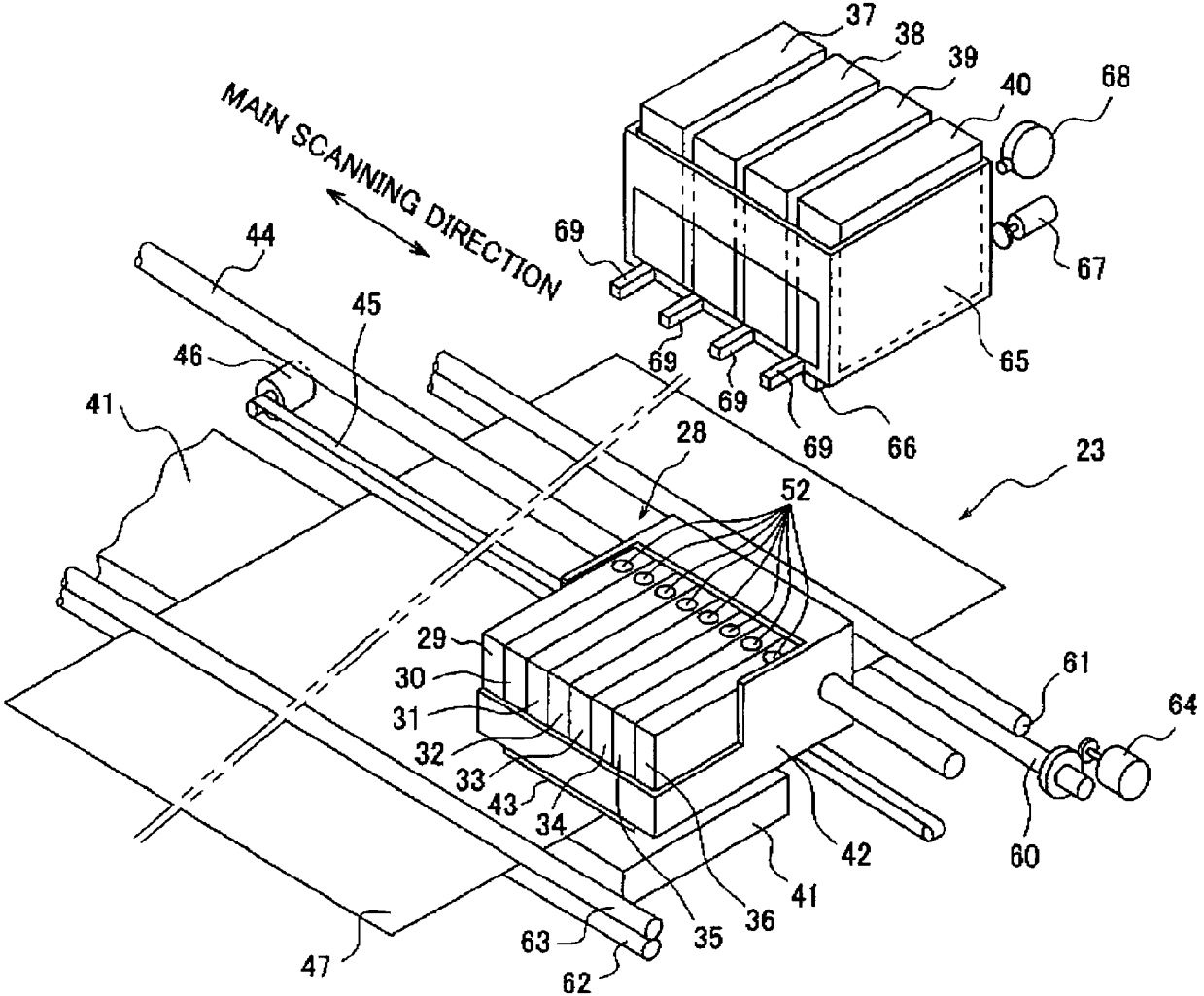
FIG. 3 is a diagram showing a structure of an image recording unit of the inkjet recording apparatus according to the embodiment.

Referring now to FIG. 3, the image recording unit 23 is provided with a head unit 28, a platen 41, a recording head 43, sub-tanks 29-36, cartridge-type ink tanks 37-40, and so forth. The platen 41 is disposed so as to face the head unit 28. The recording head 43 ejects (discharges) ink, The sub-tanks 29-36 store ink to be supplied into the recording head 43. The ink tanks 37-40 store ink to be supplied into the sub-tanks 29-36. Although the ink tanks 37-40 are shown larger than the sub-tanks 29-36 in FIG. 3 so as to facilitate understanding, the ink tanks 37-40 and the sub-tanks 29-36 are actually approximately in the same size in order to facilitate ink supply as shown in FIGS. 11-15. Additionally, a restoring spring 51*c*, to be described hereinafter, is not shown in FIG. 3.

The image recording unit 23 records an image on recording paper 47, while the head unit 28 reciprocates in a main scanning direction, by ejecting various colors of inks, such as cyan (C), magenta (M), yellow (Y), black (Bk), and so forth from the head unit 28 onto the recording paper 47 intermittently conveyed on the platen 41.

The recording head 43 and the sub-tanks 29-36 are held by a scanning carriage 42. The recording head 43 is disposed so as to be exposed on the bottom surface of the scanning carriage 42. The sub-tanks 29-36 are disposed on the upper side of the recording head 43 of the scanning carriage 42.

A guide shaft 44 is a guide member extending in the main scanning direction so as to guide and support the scanning carriage 42 so that the scanning carriage 42 can be reciprocated thereon. An endless belt 46 is disposed in parallel to the guide shaft 44 so that the scanning carriage 42 (head unit 28) can be reciprocated thereon. The endless belt 46 is driven by a belt drive motor 46 via a pulley.

Figure 4:
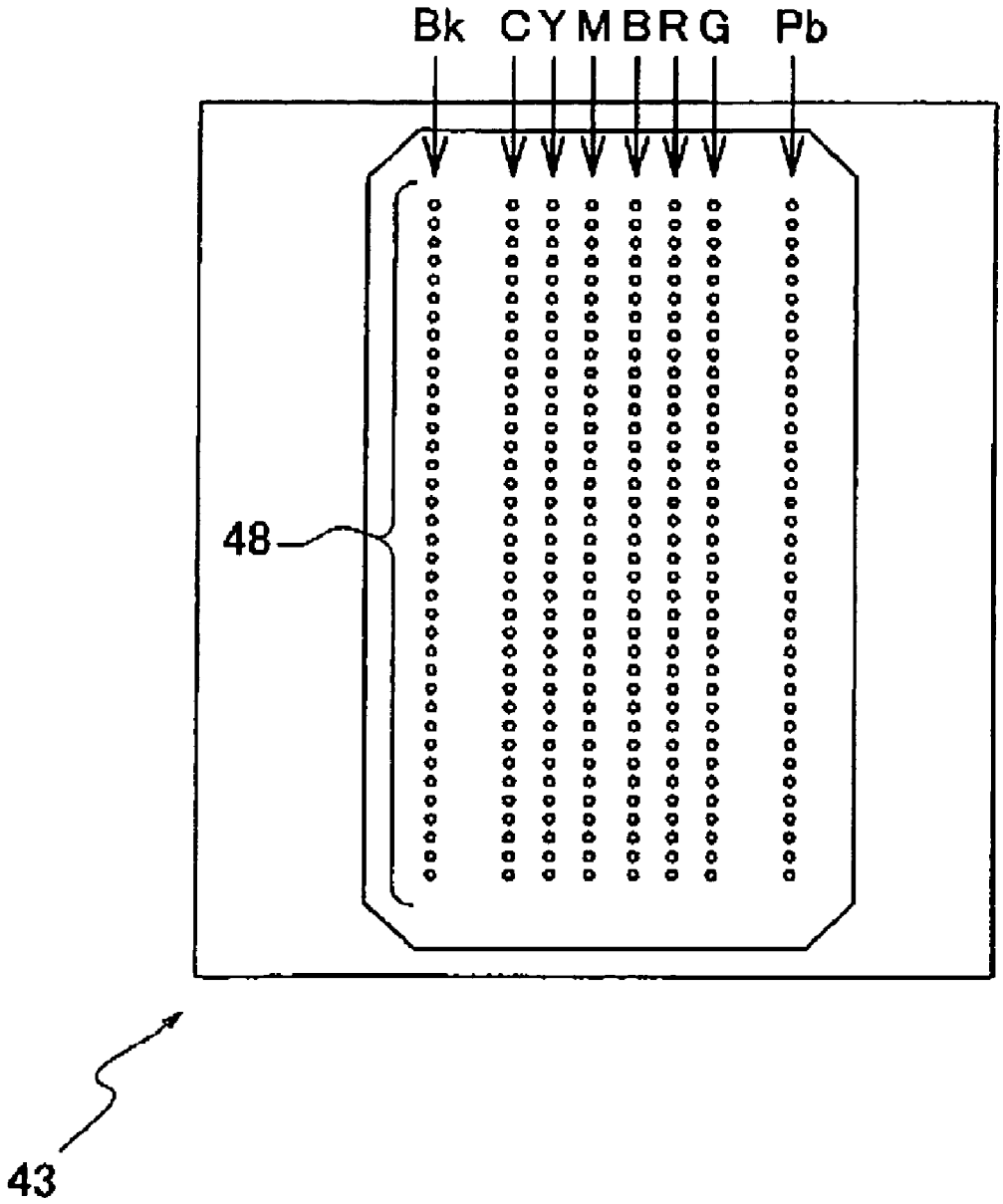
FIG. 4 is a diagram showing the bottom surface of a recording head according to the embodiment.

On the bottom surface of the recording head 43, arrays of ejection nozzles 48 are disposed wherein a plurality of inkjet nozzles 48 are aligned almost in one line as shown in FIG. 4. The number of these arrays corresponds to the number of sub-tanks 29-36 (8 arrays, in the present embodiment).

From the ink ejection nozzles 48 in the array disposed in the left end side in the drawing, black ink (to be referred to as ink Bk) is ejected. Hereinafter, in the order of the alignment of the ejection nozzles 48, cyan ink (to be referred to as ink C), yellow ink (ink Y), magenta ink (ink M), blue ink (ink B), red ink (ink R), green ink (ink G), and Photo Black ink (ink Pb) are ejected from the ejection nozzles 48 in respective arrays.

Figure 5:
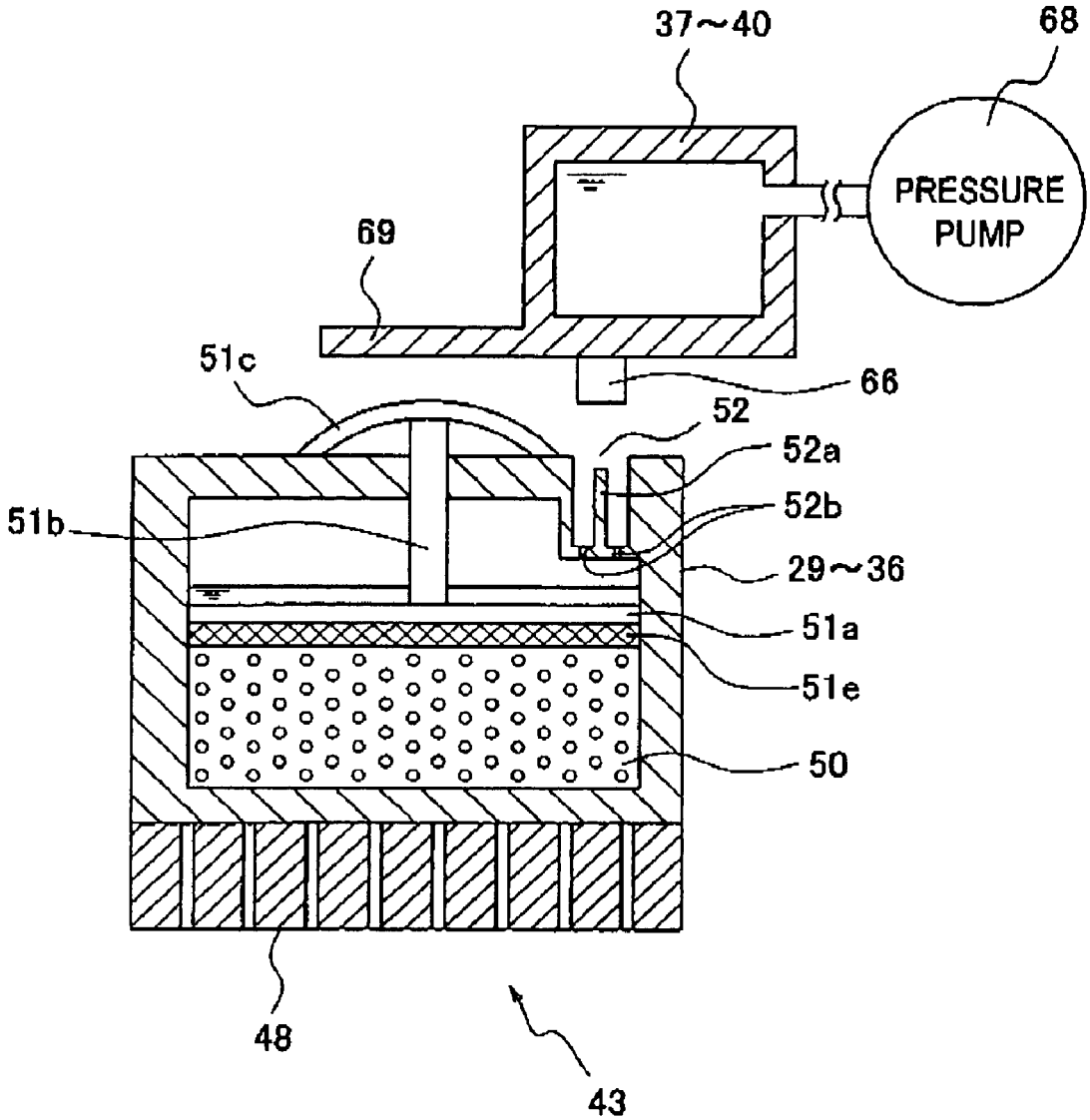
FIG. 5 is a sectional diagram showing the recording head and a sub-tank according to the embodiment.

The recording head 43 according to the present embodiment is a piezo-type recording head which ejects ink by the use of piezoelectric element (piezo element). As shown in FIG. 5, the recording head 43 receives ink supply from the sub-tanks 29-36 disposed on the top side of the recording head 43, and ejects (discharges) ink toward recording paper.

In each of the sub-tanks 29-36, an absorber 50 is stored. The absorber 50 is made of a porous resilient member which absorbs ink filled (replenished) in each of the sub-tanks 29-36. A sponge or the like is used as the absorber in the present embodiment.

A press mechanism 51 is a presser which compresses the absorbers 50 stored in each of the sub-tanks 29-36. The press mechanism 51 includes a pressing portion 51*a*, a pressing force transmission portion 51*b*, and the aforementioned restoring spring 51*c*. The pressing portion 51*a* comes in contact with the absorber 50, and applies pressing force to the absorber 50. The pressing force transmission portion 51*b* transmits pressing force so as to move the pressing portion 51*a* toward the recording head 43. The restoring spring 61*c* returns the pressing portion 51*a* and the pressing force transmission portion 51*b* to respective original positions when pressing force is removed.

Although the restoring spring 51*c* is configured with a leaf spring or a plate spring in the present embodiment, the present invention is not limited to this embodiment.

Figure 6A:
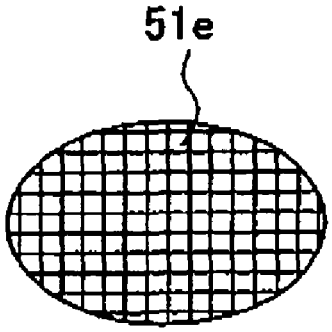
FIGS. 6A and 6B are diagrams in which GA showing a front view of a pressing portion, and 6B showing a front view of a mesh filter according to the embodiment.
Figure 6B:
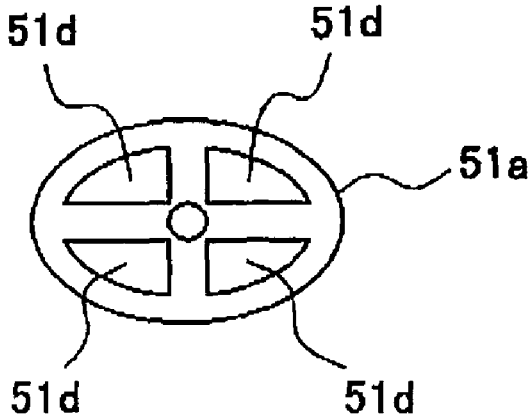

As shown in FIG. 6B, the pressing portion 51*a* is provided with a plurality of communication holes 51*d* which ink can flow. Ink replenished (supplied) into each of the sub-tanks 29-36 goes through these communication holes 51*d*, and is absorbed in the absorber 50. In the present embodiment, a mesh filter 51*e* (see FIG. 6A), having a number of small openings formed thereon, is interposed between the pressing portion 51*a* and the absorber 50 so as to adjust the passage resistance through the communication holes 51*d*.

As shown in FIG. 5, on the top surface of each of the sub-tanks 29-36, an ink supply hole 52 is disposed for ink supplied from the ink tanks 37-40. In the bottom portion of the ink supply hole 52, a push rod 52*a* is provided for opening an on-off valve 58 (see FIG. 7) disposed in each of the ink tanks 37-40. On the root portion of the push rod 52*a*, communication holes 52*b* are provided so that each supply hole 52 is communicated with one of the sub-tanks 29-36.

2.3 Ink Tanks 37-40

The ink tanks 37-40 are replenishment tanks wherein ink is stored so as to be replenished and supplied into the sub-tanks 29-36. In the present embodiment, the number of the ink tanks 37-40 is less than the number of the sub-tanks 29-36 as shown in FIG. 3. In the ink tanks 37-40, inks of basic colors (to be referred to as basic inks) are stored.

The basic inks, mentioned here, are in some colors which compose the basis of the colors of inks stored in the sub-tanks 29-36. Four colors of inks: ink Bk, ink C, ink Y, and ink M are employed as the basic inks in the present embodiment.

The ink tanks 37-40 are held by a holder 65 disposed immediately above the scanning path of the head unit 28 (above the head unit 28). On the bottom portion of respective ink tanks 37-40, a connecting portion 66 is provided so as to be connected to the above-described supply opening 52 of respective sub-tanks 29-36.

Figure 7A:
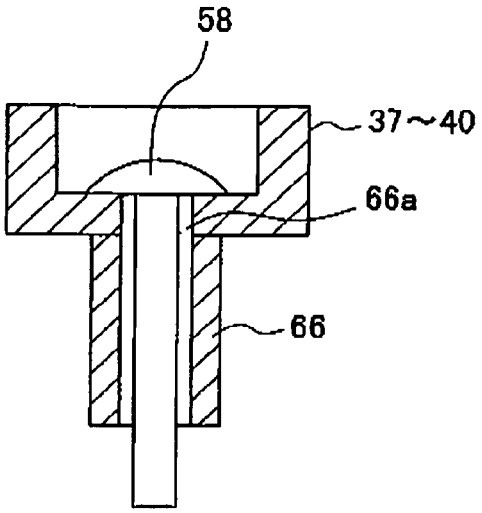
FIGS. 7A and 7B are sectional diagrams showing a connecting portion of an ink tank according to the embodiment.
Figure 7B:
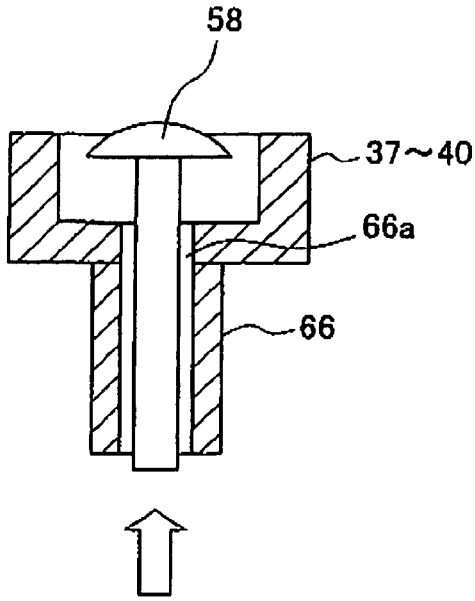

Inside of the connecting portion 66, the on-off valve 58, which opens and closes an ink replenishment opening 66*a* disposed within the connecting portion 66, is provided as shown in FIGS. 7A and 7B. The on-off valve 58 opens the ink replenishment opening 66*a* by being pressed by the push rod 52*a* when the connecting portion 66 is connected to the supply opening 52. When the connecting portion 66 is removed from the supply opening 52, the on-off valve 58 closes the ink replenishment opening 66*a* by the pressure of ink in respective ink tanks 37-40 and the resilient force of a spring, which is not shown in the drawing.

The ink tanks 37-40 are respectively provided with a slide cylinder 67, a pump 68, and pressing force providing portion 69 as shown in FIG. 3. The slide cylinders 67 provide driving force so as to individually lower the ink tanks 37-40 toward the sub-tanks 29-36. The pumps 68 pressurize inside of the ink tanks 37-40. The pressing force providing portions 69 come in contact with the pressing force transmission portions 51*b* (restoring springs 51*c*) and press the pressing force transmission portions 51*b*.

Respective slide cylinders 67 and the pumps 68 are fixed to the holder 65. The pressing force providing portions 69 are integrated with respective ink tanks 37-40. In FIG. 3, only one slide cylinder 67 and one pump 68 of the ink tank 40 are shown in order to simplify the drawing, Additionally, in FIG. 3, the slide cylinder 67 is disposed so as to provide the driving force of the slide cylinder 67 from the back side of the ink tanks 37-40. However, the driving force of the slide cylinder 67 is provided to link mechanisms or the like, which are not shown in the drawing and respectively provided to each of the ink tanks 37-40. The driving force is converted into driving force which lowers the ink tanks 37-40 toward the sub-tanks 29-36, and then, provided to the ink tanks 37-40. Although the connection between the pump 68 and the ink tank 40 is not shown in FIG. 3 in order to simplify the drawing, pumps 68 are respectively connected to the ink tanks 37-40 via, for example, tubes (see FIGS. 5 and 9).

2.4 Conveyance Mechanism for Recording Paper

As shown in FIGS. 2 and 3, in the upstream side of the image recording unit 23, a driving roller 60 and a retaining roller 61 are provided. The driving roller 60 and the retaining roller 61 sandwich the recording paper 47 conveyed in the conveyance path 22, and feed the recording paper 47 onto the platen 41. The driving roller 60 is driven and rotated by a motor 64.

On the other hand, in the downstream side of the image recording unit 23, a paper discharge roller 62 and a retaining roller 63 are disposed. The paper discharge roller 62 and the retaining roller 63 sandwich the recording paper 47 on which image recording is finished, and feed the recording paper 47. The paper discharge roller 62 is driven and rotated by a motor (not shown) which is similar to the motor 64 for the driving roller 60.

The retaining roller 61 is resiliently pressed against the driving roller 60 so that the retaining roller 61 presses the driving roller 60 with predetermined pressing force. When the recording paper 47 enters between the driving roller 60 and the retaining roller 61, the retaining roller 61 resiliently recedes for the thickness of the recording paper 47 and holds the recording paper 47 together with the driving roller 60.

Similarly, the retaining roller 63 is resiliently pressed against the paper discharge roller 62. However, since the retaining roller 63 comes in contact with the recording paper 47 on which image recording is finished, the surface of the retaining roller 63 is formed spur-like, in order not to deteriorate the image recorded on the recording paper 47.

The recording paper, held by the driving roller 60 and the retaining roller 61, is intermittently fed in predetermined linefeed widths on the platen 41. Correspondingly, the recording head 43 is moved in parallel every time the recording paper 47 is fed for a new line, and performs image recording from the leading end side of the recording paper 47. The recording paper 47, wherein image recording is finished, is discharged onto the paper discharge tray 15.

3. Electrical Structure of Multifunction Apparatus 10

Figure 8:
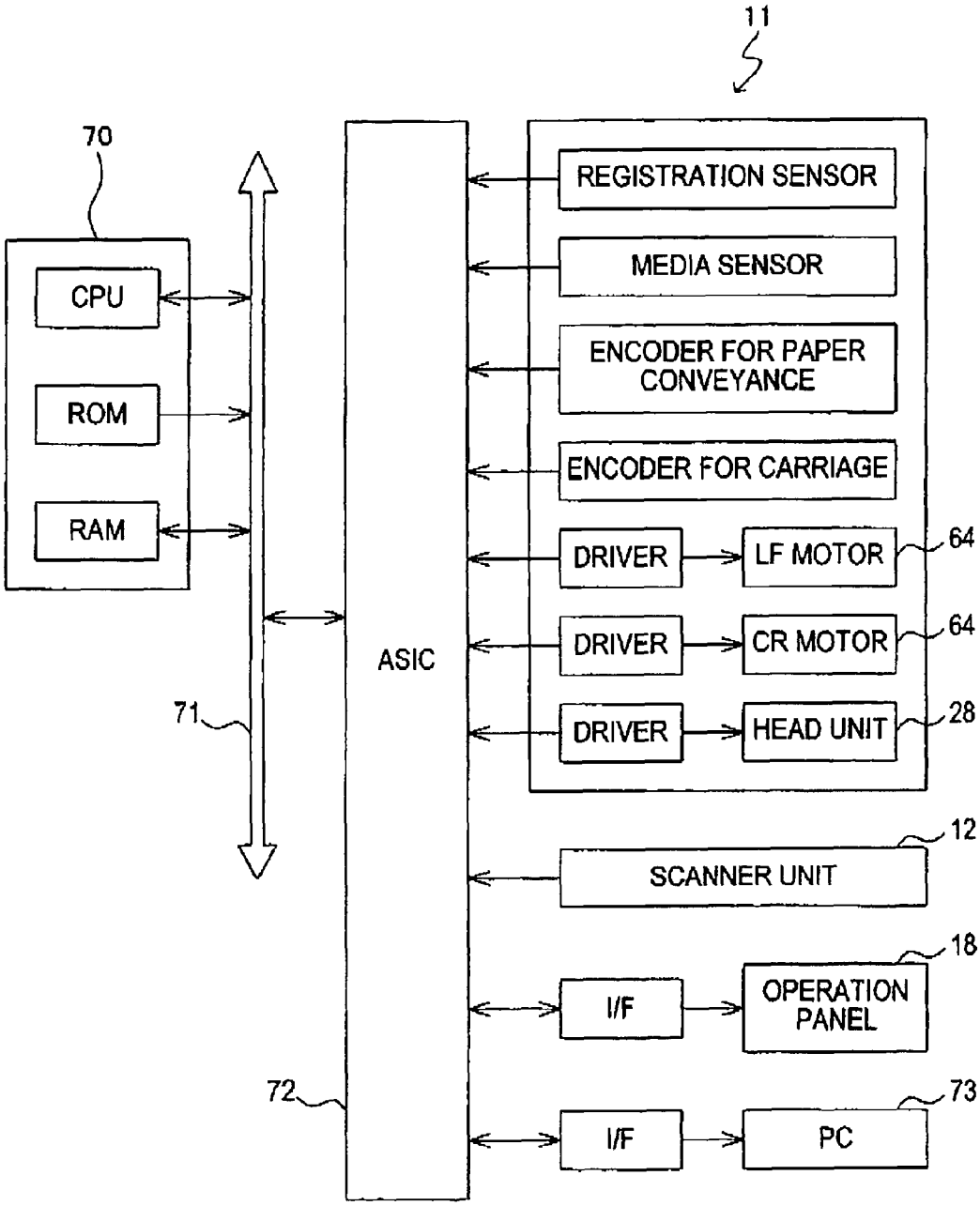
FIG. 8 is a diagram showing an electrical structure of the inkjet recording apparatus according to the embodiment.

Referring now to FIG. 8, a control device of the multifunction apparatus 10 according to the present embodiment is a micro computer having a central processing unit 70 with a CPU, a ROM, and a RAM. The central processing unit 70 is connected to various sensors, the printer unit 11, the scanner unit 12, the operation panel 18, and so forth via a bus 71 and an ASIC (Application Specific Integrated Circuit) 72 so as to be able to transmit/receive data to/from these components.

The ROM, provided in the central processing unit 70, stores predetermined computer programs. In accordance with the programs stored in the ROM and based on information from various sensors, the CPU performs control processes and other processes. The CPU controls the rotation of the motor 64 (LF motor), which is the driving source of the driving roller 60, and the rotation of the belt driving motor 46 (CR motor) so as to make the head portion 28 slide. The CPU also controls the extension and contraction of the slide cylinder 67 so as to move the ink tanks 37-40 toward the head portion 28, and controls the pump 68 so as to supply the basic ink stored in the ink tanks 37-40 into the sub-tanks 29-36.

The multifunction apparatus 10 according to the present embodiment includes an interface (I/F) for transmitting/receiving data to/from a personal computer (PC) 73. When the I/F is connected to the PC 73, a graphic image or a text image can be recorded on the recording paper 47 based on graphic data or text data transmitted from the PC 73.

4. Operation of Printer Unit 11 (Inkjet Recording Apparatus)

The printer unit 11 (inkjet recording apparatus) according to the present embodiment is different from a general inkjet recording apparatus in the structure and the operation for replenishing and supplying ink from the ink tanks 37-40 into the sub-tanks 29-36. The following describes the operation of the printer unit 11 (inkjet recording apparatus) focusing especially on the ink replenishment operation.

4.1 Overall Operation of Ink Replenishment

Firstly, the scanning carriage 42 is moved so that the sub-tanks 29-36, which receive ink supply, are positioned immediately below the ink tanks 37-40 which store specific colors of inks the sub-tanks 29-36 should be receiving.

Next, the slide cylinders 67 are extended so as to lower the ink tanks 37-40 toward the sub-tanks 29-36. The connecting portions 66 of the ink tanks 37-40 are inserted into the supply openings 52 of the sub-tanks 29-36 and connected thereto.

At this time, the on-off valves 58 are pressed by the push rods 52*a* and open the ink replenishment openings 66*a* (see FIG. 7B). The pumps 68 are operated so as to supply ink inside of the ink tanks 37-40 into the sub-tanks 29-36.

Figure 9:
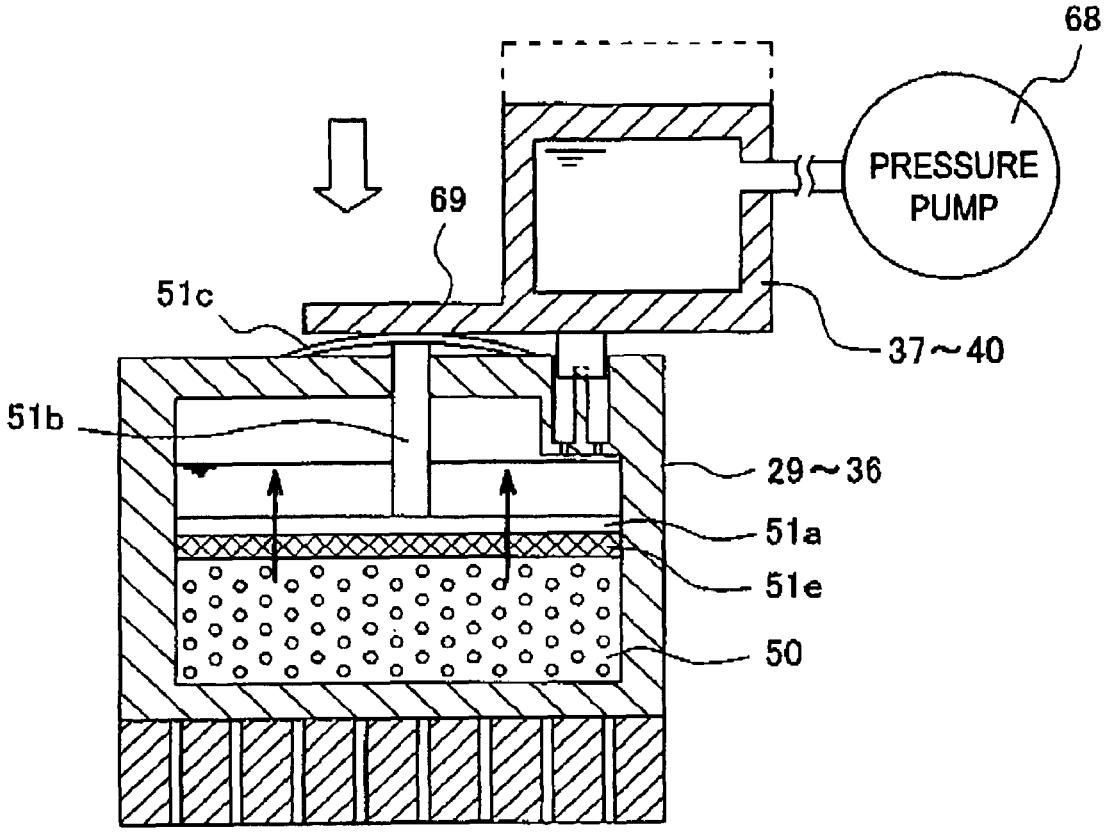
FIG. 9 is a sectional diagram showing the recording head and the sub-tank in an ink replenishment state according to the embodiment.

Moreover, when the ink tanks 37-40 are lowered and the connecting portions 66 are inserted into the supply openings 52, as shown in FIG. 9, the pressing force providing portions 69 contact with the restoring springs 51*c* and press the pressing force transmission portions 51*b*. As a result, the pressing portions 51*a* are moved toward the recording head 43, and the absorbers 50 are compressed.

When the amount of inks inside of the sub-tanks 29-36 becomes equal to or more than a predetermined amount and ink replenishment finishes, the pumps 68 are stopped. Then, the slide cylinders 67 are contracted so as to raise the ink tanks 37-40.

Consequently, the push rods 52*a* are moved away from the on-off valves 58 and close the ink replenishment openings 66*a*. The pressing force providing portions 69 are moved away from the restoring springs 51*c*. Due to the restoring force of the restoring springs 51*c*, the pressing force transmission portions 51*b* and the pressing portions 51*a* are elevated. Correspondingly, the compressed absorbers 50 gradually expand.

Plurality types of the basic inks are supplied into at least one of the sub-tanks 29-36 (into four sub-tanks, in the present embodiment). Therefore, in the present embodiment, one type of the basic ink is supplied into the sub-tanks 29-32, and plurality types of the basic inks are supplied into the sub-tanks 33-36.

The sub-tanks 29-32, wherein one type of the basic ink is respectively stored, will be referred to as basic color sub-tanks. The sub-tanks 33-36, wherein plurality types of the basic inks are supplied, will be referred to as mixed color sub-tanks. The ink, mixed in the mixed color sub-tanks, will be specifically referred to as mixed ink.

In the mixed color sub-tanks 33-36, mixed inks: ink B, ink R, ink G, and ink Pb are respectively stored. Ink B is produced with ink C and ink M mixed together. Ink R is produced with ink Y and ink M mixed together. Ink G is produced with ink Y and ink C mixed together. Ink Pb is produced with ink Y, ink M, and ink C mixed together.

4.2 Ink Replenishment Operation Control

Figure 10:
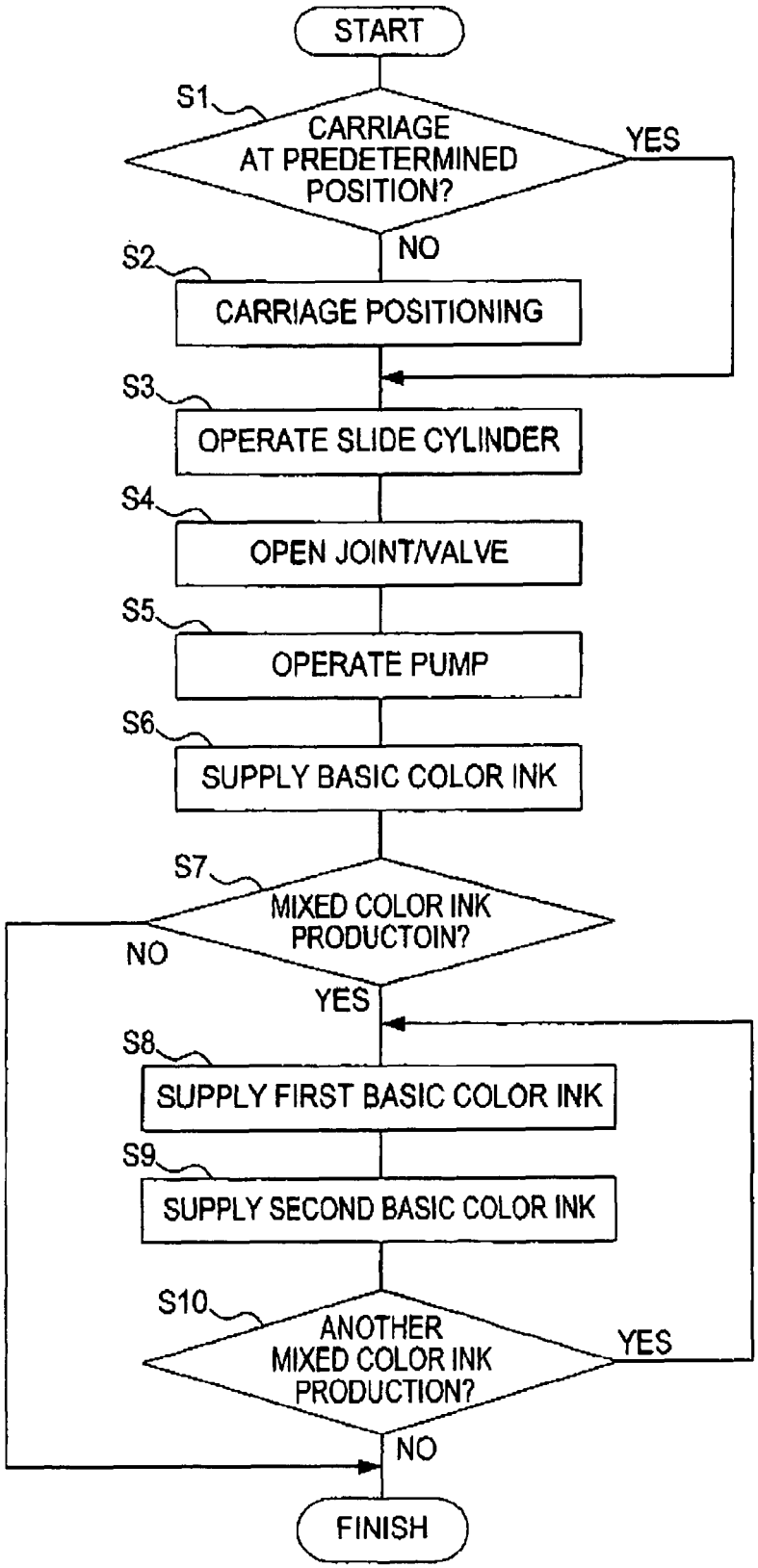
FIG. 10 is a flowchart explaining an ink replenishment operation of the inkjet recording apparatus according to the embodiment.

Following describes the above-described replenishment operation, wherein the basic ink is replenished from the ink tank 37-40 into the sub-tanks 29-36, with reference to the flowchart shown in FIG. 10.

Firstly, the basic inks are supplied from the ink tanks 37-40 into the basic color sub-tanks 29-32. Specifically, in S1, it is determined whether or not the scanning carriage 42 of the head unit 28 is positioned at a predetermined position, that is, at an end of a scannable area where the scanning carriage 42 can perform scanning. This determination is made, for example, based on an input signal from a position sensor for the scanning carriage 42, such as an encoder.

If it is determined that the scanning carriage 42 is not positioned at the predetermined position (S1:NO), in S2, the belt drive motor 46 is driven so as to move the scanning carriage 42 to the predetermined position. In S3, the slide cylinders 67 are operated. In S4, the connecting portions 66 of respective ink tanks 37-40 and the supply openings 52 of the sub-tanks 29-32 are connected, so that the on-off valves 58 of the connecting portions 66 open the ink replenishment openings 66*a*. In S5, the pumps 68 are operated. As a result, in S6, the basic inks are independently supplied into respective sub-tanks 29-32.

If it is determined that the scanning carriage 42 is positioned at the predetermined position (S1:YES), the process in S2 is omitted and the process in S3 is executed.

Subsequently, in S7, it is determined whether or not production of mixed ink is necessary. This determination is made, for example, based on an input signal from a sensor which detects the ink level (the level of ink surface) in each of the sub-tanks 29-36. If it is determined that production of mixed ink is necessary (S7:YES), the belt drive motor 46 is driven so as to move the scanning carriage 42 to a predetermined position.

The "predetermined position" mentioned here is a position where one of the sub-tanks 33-36 (for example, the sub-tank 33), wherein inks are to be mixed, faces an ink tank (for example, the ink tank 38) which stores the basic ink to be supplied into the sub-tank.

Subsequently, the slide cylinder 67 is operated. The connecting portion 66 of a predetermined ink tank (for example, the ink tank 38) and the supply opening 52 of the sub-tank (for example, the sub-tank 33) are connected. The on-off valve 58 of the connecting portion 66 opens the ink replenishment opening 66*a*. The pump 68 is operated. As a result, in S8, a first basic ink is supplied into the sub-tank 33 from the ink tank 38.

When the supply of the first basic ink finishes in S8, in S9, supply of a second basic ink, to be mixed with the first ink, is initiated. That is, in the same manner as in S8, the belt drive motor 46 is driven so as to move the scanning carriage 42 to a predetermined position.

The "predetermined position" mentioned here is a position where one of the sub-tanks 33-36 (for example, the sub-tank 33), wherein inks are to be mixed, faces another ink tank (for example, the ink tank 38) which stores basic ink to be supplied into the sub-tank.

Then, the slide cylinder 67 is operated. The connecting portion 66 of a predetermined ink tank (for example, the ink tank 39) and the supply opening 52 of the sub-tank (for example, the sub-tank 33) are connected. The on-off valve 58 of the connecting portion 66 opens the ink replenishment opening 66*a*. The pump 68 is operated. As a result, the second basic ink is supplied into the sub-tank 33 from the ink tank 39.

Subsequently, in S10, it is determined whether or not production of another mixed ink is necessary. If it is determined that production of another mixed ink is necessary (S10:YES), another mixed ink is produced in the same manner as in the processes in S8 and S9. On the other hand, if it is determined that production of another mixed ink is not necessary (S10: NO), the flow of the present control finishes.

4.3 Detail of Ink Replenishment Operation 4.3.1 Basic Ink Replenishment

Figure 11:
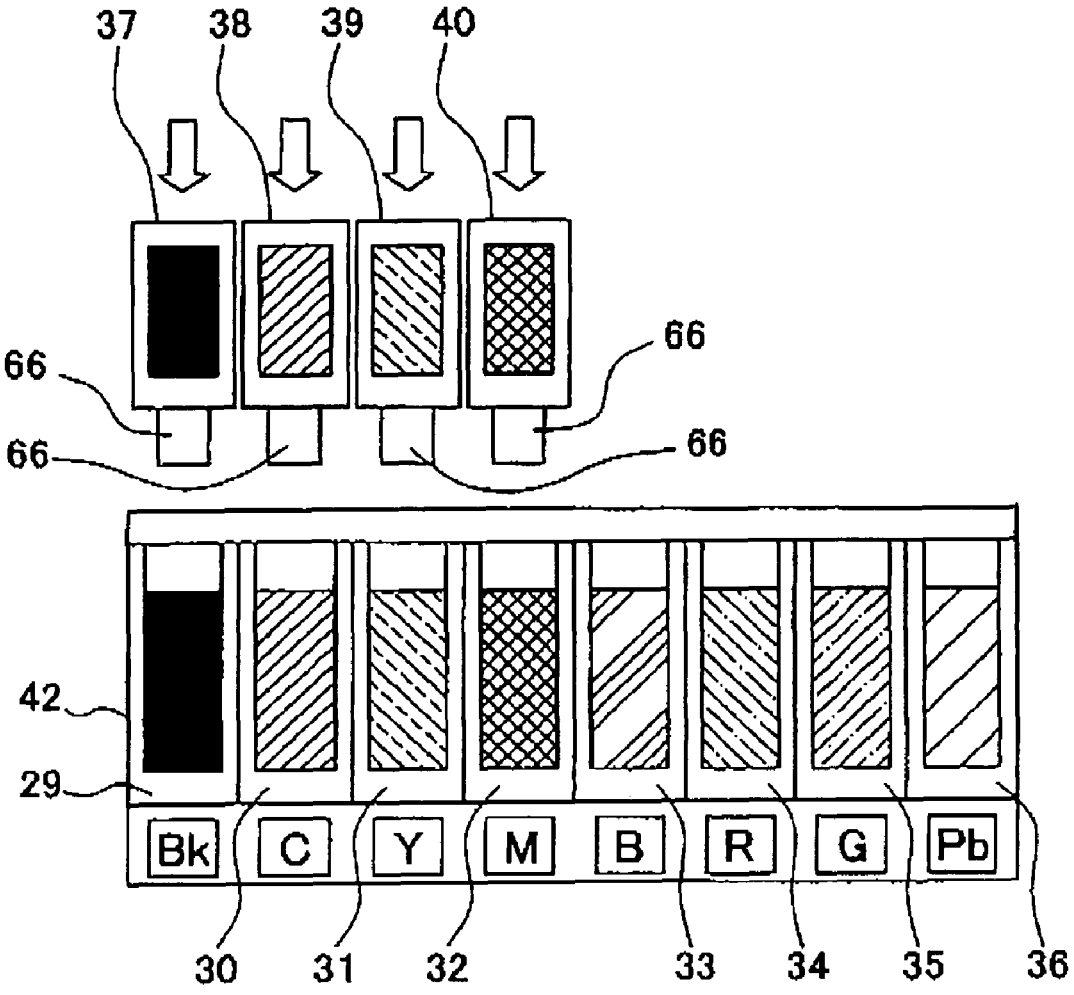
FIG. 11 is a diagram showing the ink replenishment operation of the inkjet recording apparatus according to the embodiment.

In accordance with the processes in S2 to S6 of the ink replenishment operation control (see FIG. 10), the scanning carriage 42 is positioned, and respective ink tanks 37-40 are connected to the sub-tanks 29-32, as shown in FIG. 11.

At this time, upon the connecting portions 66 of respective ink tank 37-40 being inserted into the supply openings 52 of the sub-tanks 29-32, the pumps 68 are operated and the basic inks are respectively supplied into the sub-tanks 29-32.

4.3.2 Production of Mixed Ink (Ink B)

Ink B is produced with, among the basic inks, ink C and ink M mixed together. Firstly, as shown in FIG. 12A, the ink tank 38 is positioned immediately above the sub-tank 33 which is allocated for producing mixed ink (ink B). The ink tank 38 is lowered so as to be connected to the sub-tank 33. Then, ink C is supplied into the sub-tank 33.

Figure 12B:
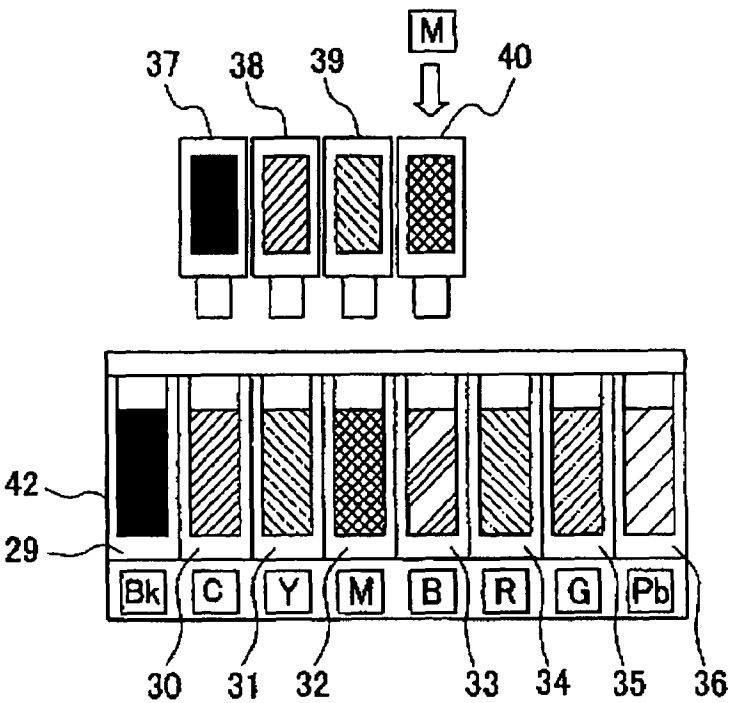
FIGS. 12A and 12B are diagrams showing the ink replenishment operation of the inkjet recording apparatus according to the embodiment.
Figure 12A:
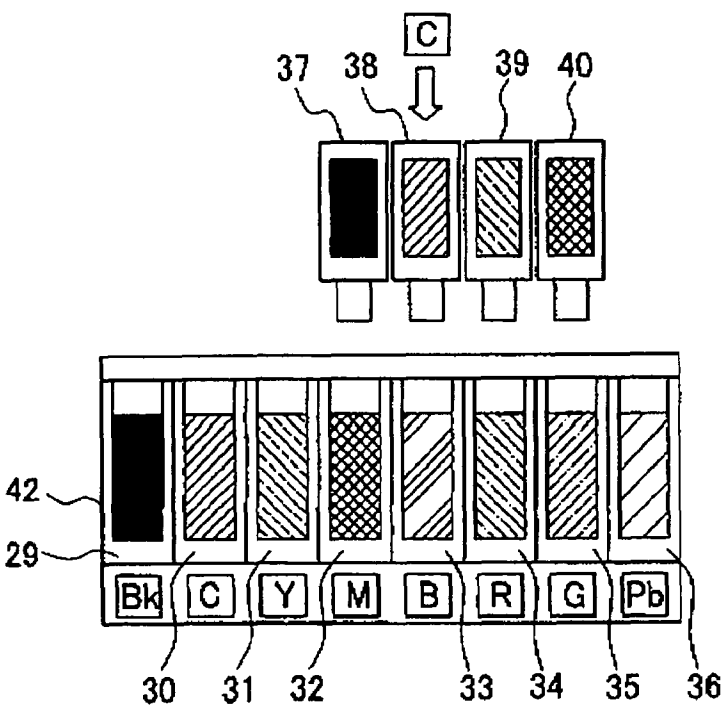

Secondly, as shown in FIG. 12B, the ink tank 40 is positioned immediately above the sub-tank 33. The ink tank 40 is lowered so as to be connected to the sub-tank 33. Then, ink M is supplied into the sub-tank 33. As a result, ink B is produced in the sub-tank 33.

The way of producing ink B is not limited to the above-described example. Contrary to the order of ink supply in the above example, ink M can be firstly supplied into the sub-tank 33, and then ink C can be supplied. In other words, among the plurality of the basic inks to be mixed, inks should be preferably supplied into the sub-tank 33 in the order from a relatively paler color.

4.3.3 Mixed Ink (Ink R)

Ink R is produced with, among the basic inks, ink Y and ink M mixed together. Firstly, as shown in FIG. 13A, the ink tank 39 is positioned immediately above the sub-tank 34 which is allocated for producing mixed ink (ink R). The ink tank 39 is lowered so as to be connected to the sub-tank 34. Then, ink Y is supplied into the sub-tank 34.

Figure 13B:
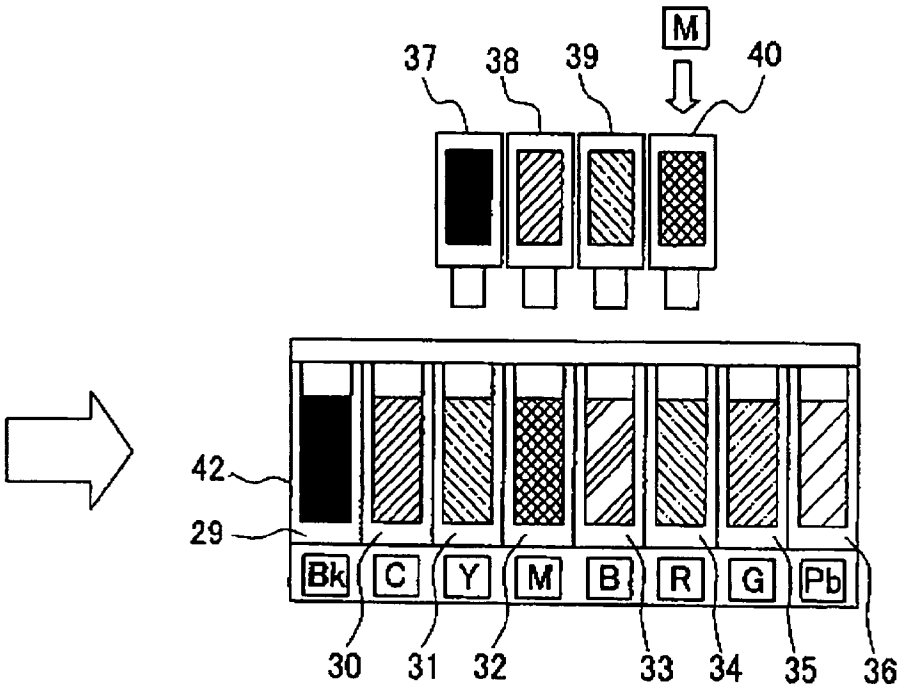
FIGS. 13A and 13B are diagrams showing the ink replenishment operation of the inkjet recording apparatus according to the embodiment.
Figure 13A:
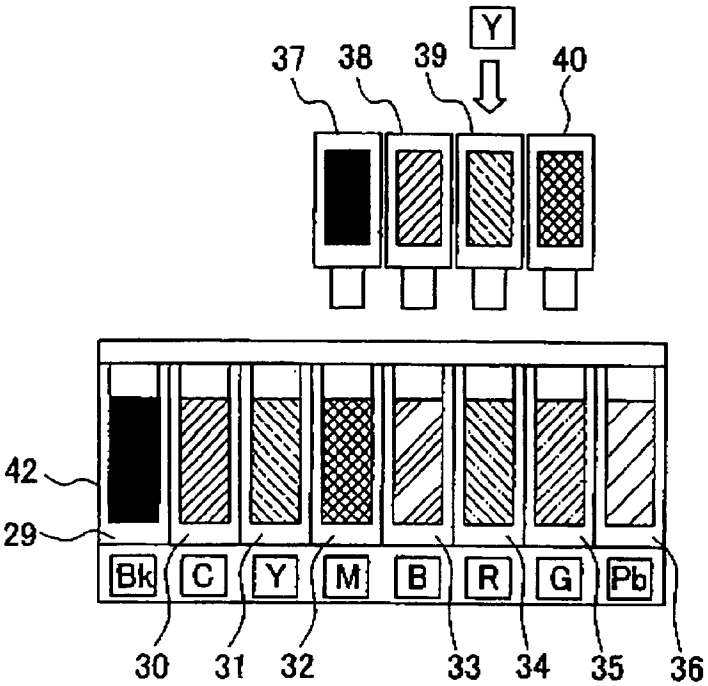

Secondly, as shown in FIG. 13B, the ink tank 40 is positioned immediately above the sub-tank 34. The ink tank 40 is lowered so as to be connected to the sub-tank 34. Then, ink M is supplied into the sub-tank 34. As a result, ink R is produced in the sub-tank 34.

The way of producing ink R is not limited to the above-described example, Contrary to the order of ink supply in the above example, ink Y can be firstly supplied into the sub-tank 34, and then ink M can be supplied.

4.3.4 Mixed Ink (Ink G)

Ink G is produced with, among the basic inks, ink Y and ink C mixed together. Firstly, as shown in FIG. 14A, the ink tank 39 is positioned immediately above the sub-tank 35 which is allocated for producing mixed ink (ink G). The ink tank 39 is lowered so as to be connected to the sub-tank 35. Then, ink Y is supplied into the sub-tank 35.

Figure 14B:
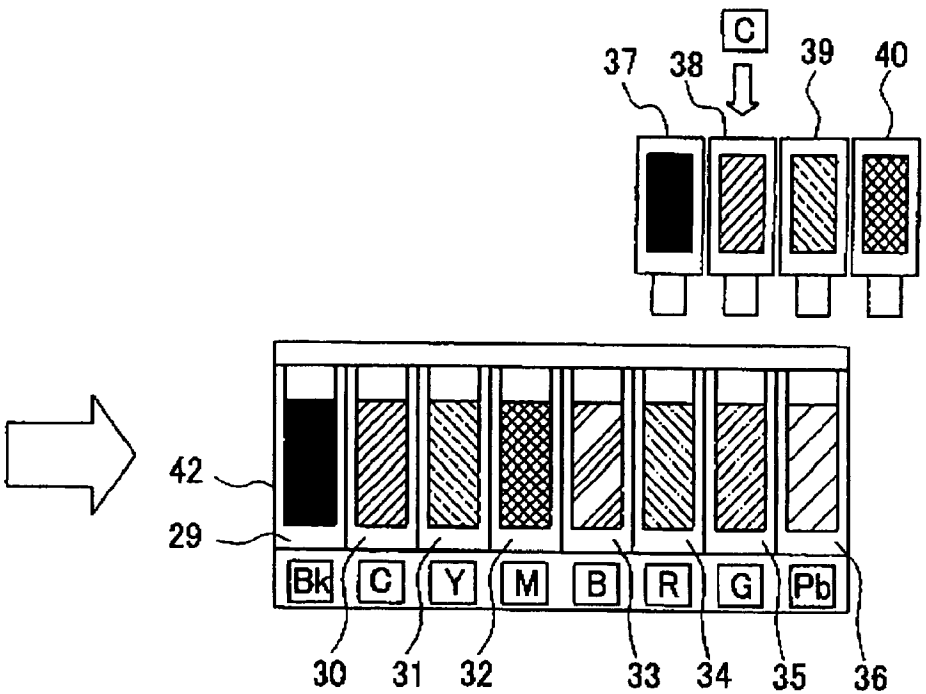
FIGS. 14A and 14B are diagrams showing the ink replenishment operation of the inkjet recording apparatus according to the embodiment.
Figure 14A:
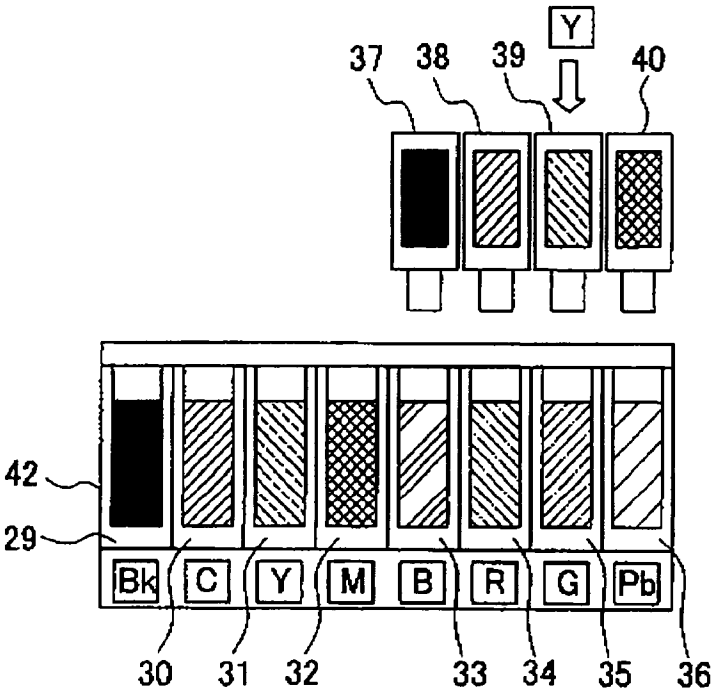

Secondly, as shown in FIG. 14B, the ink tank 38 is positioned immediately above the sub-tank 35. The ink tank 38 is lowered so as to be connected to the sub-tank 35, Then, ink C is supplied into the sub-tank 35. As a result, ink G is produced in the sub-tank 35.

The way of producing ink G is not limited to the above-described example. Contrary to the order of ink supply in the above example, ink Y can be firstly supplied into the sub-tank 35, and then ink C can be supplied.

4.3.5 Mixed Ink (Ink Pb)

Figures 15A, 15B, 15C:
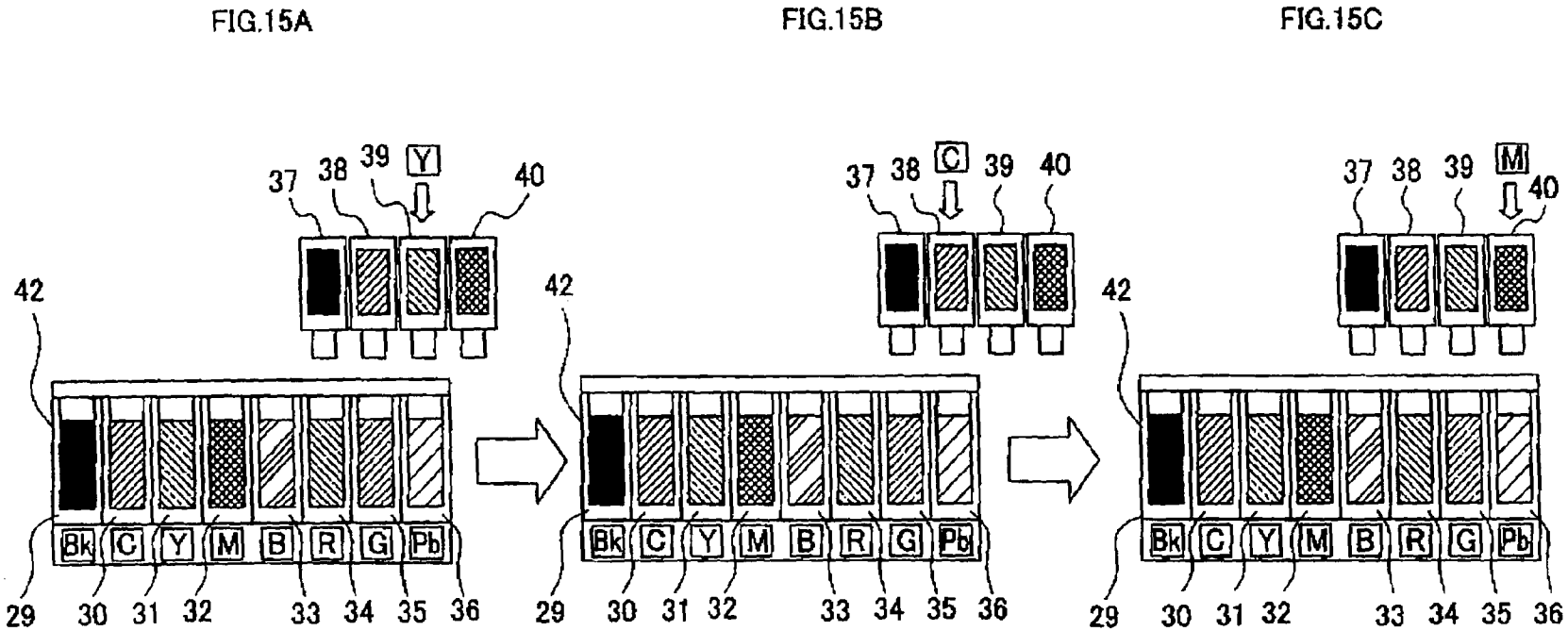
FIGS. 15A, 15B, and 15C are diagrams showing the ink replenishment operation of the inkjet recording apparatus according to the embodiment.

Ink Pb is produced with three types of inks among the basic inks, that is, ink Y, ink C, and ink M mixed together. Firstly, as shown in FIG. 15A, the ink tank 39 is positioned immediately above the sub-tank 36 which is allocated for producing mixed ink (ink Pb). The ink tank 39 is lowered so as to be connected to the sub-tank 36. Then, ink Y is supplied into the sub-tank 36.

Secondly, as shown in FIG. 15B, the ink tank 38 is positioned immediately above the sub-tank 36. The ink tank 38 is lowered so as to be connected to the sub-tank 36. Then, ink C is supplied into the sub-tank 36.

Furthermore, as shown in FIG. 15C, the ink tank 40 is positioned immediately above the sub-tank 36. The ink tank 40 is lowered so as to be connected to the sub-tank 36. Then, ink M is supplied into the sub-tank 36. As a result, ink Pb is produced in the sub-tank 36.

The way of producing ink Pb is not limited to the above-described example. The inks can be supplied into the sub-tank 36, for example, in the order from a relatively paler color, that is, in the order of ink Y, ink M, and ink C.

5. Characteristic of Inkjet Recording Apparatus (Printer Unit 11) According to Present Embodiment In the present embodiment, when ink is replenished, the absorber 50 is pressed by the press mechanism 51 so as to be compressed in a squashed manner. Therefore, ink absorbed (held) in the absorber 50 can be once forcibly discharged from the absorber 50.

When the compression by the press mechanism 51 is released, the absorber 50 tends to expand (enlarge) up to the original size thereof because of the restoring force (resilient force) of the absorber 50. Therefore, due to the negative pressure generated inside of the absorber 50 when the absorber 50 expands, not only the ink, once discharged when the absorber is compressed, but ink, which is replenished and exists around the absorber 50, is also absorbed into the absorber 50.

In the present embodiment, ink, which exists around the absorber 50, can be reliably absorbed into the absorber 50 by use of the negative pressure generated inside of the absorber 50 when compression by the press mechanism 51 is released and the absorber 50 expands. As a result, the effectiveness in ink replenishment can be improved.

In fact, when the absorber 50 is compressed, compressing pressure affects the recording head 43 and there is a possibility that meniscus might be destroyed. Therefore, the descending speed and the pressing force of the pressing force providing portion 69 (ink tanks 37-40) is preferably as high so that the meniscus on the recording head 43 can be maintained.

When the absorber 50 is in the compressed state, small holes formed on the absorber 50 are squashed, and the absorbing ability of the absorber 50 is decreased. Consequently, when the absorber 50 is in the compressed state, the ink, discharged from the absorber 50, and the ink, newly replenished, can move freely without being restrained by the absorber 50.

As a result, by compressing the absorber 50 once when ink is replenished (supplied) into the sub-tanks 29-36, the ink, discharged from the absorber 60, and the ink, newly replenished, can be reliably mixed together and the mixed liquid can be reliably absorbed into the absorber 50. Furthermore, the quality of image recording can be improved since uniformly mixed ink can be produced.

Additionally, since the pressing force transmission portion 51*b* is pressed by the pressing force providing portion 69 integrally formed with the ink tanks 37-40, the absorber 50 can be compressed/expanded by the descendant/ascendant of the ink tanks 37-40.

Therefore, the absorber 50 can be reliably compressed or expanded with the ink replenishment operation, without separately providing an additional actuator only for compressing and expanding the absorber 50. As a result, without increasing the number of parts and the manufacturing cost of the inkjet recording apparatus (printer unit 11), the effectiveness in ink replenishment and the mixing performance can be improved.

Additionally, since the plurality of communication holes 51*d* are formed on the pressing portion 51*a*, when ink is replenished (supplied) into the sub-tanks 29-36, the absorber 50 can be in contact with ink in several portions of the absorber 50. As a result, ink can be absorbed not into a specific portion of the absorber 50, but into the entire portion of the absorber 50. The effectiveness in ink replenishment, therefore, can be furthermore improved.

Other Embodiments

In the above-described embodiment, the pressing force providing portion 69 is integrally formed on each of the ink tanks 37-40, and compression and expansion of the absorber 50 is carried out by use of the up-and-down movement of the ink tanks 37-40. However, the present invention is not limited to this embodiment. The absorber 50 can be also compressed by, for example, depression of the pressing force transmission portion 51*b* carried out by manual operation, Moreover, in the above-described embodiment, the pressing portion 51*a* is provided with the plurality of communication holes 51*d*. However, the present invention is not limited to this embodiment. The pressing portion 51*a* can be provided with only one communication hole 51*d*. Alternatively, the communication hole(s) can be dispensed with. In a case wherein the communication hole 51*d* is dispensed with, some kind of structure is necessary so that the absorber 50 contacts with ink with, for example, the side surface thereof.

Furthermore, in the above-described embodiment, the absorber 50 is compressed or expanded by the up-and-down movement of the pressing force transmission portion 51*b* and the ink tanks 37-40. However, the present invention is not limited to this embodiment. The absorber 50 can be compressed or expanded, for example, by horizontal movement of the pressing force transmission portion 51*b* and the ink tanks 37-40.

Still furthermore, in the above-described embodiment, the slide cylinders 67 are provided in the back side of the ink tanks 37-40. However, the present invention is not limited to this embodiment. The slide cylinders 67 can be provided on the top side of the ink tanks 37-40, and directly provide the driving force from upside onto the ink tanks 37-40.

In addition, in the above-described embodiment, the pressure pumps 68 are fixed on the holder 68. However, the present invention is not limited to this embodiment. The pressure pumps 68 can be respectively fixed on a position inside of the multifunction apparatus 10, other than on the holder 68.

Moreover, in the above-described embodiment, the mesh filter 51*e* is disposed between the pressing portion 51*a* and the absorber 50. However, the present invention is not limited to this embodiment. The mesh filter 51*e*, for example, can be dispensed with, or can be attached to the pressing portion 51*a* on the side toward the pressing force transmission portion 51*b*.

Additionally, in the above-described embodiment, the present invention is applied to the inkjet recording apparatus in which mixed ink can be produced by mixing plurality types of basic inks. However, application of the present invention is not limited to this embodiment. The present invention can be also applied to an inkjet recording apparatus in which mixed ink is not produced.

Moreover, application of the present invention is not limited to an inkjet recording apparatus. The present invention can be also applied to, for example, a soldering equipment, which automatically performs soldering on various printed-wiring boards by ejecting molten solder from a nozzle. Moreover, the present invention can be applied to a device for forming an organic film by ejecting polymeric organic material (illuminant) in an inkjet manner for producing organic EL displays. Furthermore, the present invention can be applied to various droplet ejection apparatus which are constituted so as to eject liquid stored in a sub-tank from a nozzle in the form of droplets, such as an apparatus which slurries resin and ejects the resin from a nozzle.

Although the specific embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A droplet ejection apparatus comprising:

a head unit having at least one sub-tank that stores liquid, and an ejection head that ejects the liquid supplied from the sub-tank in a form of droplets;

a head unit mover that moves the head;

an absorber stored inside the sub-tank, and made of a porous resilient member that absorbs the liquid inside the sub-tank;

a presser that compresses the absorber which has the liquid absorbed therein with a compression force, such that at least two different states of compression of the absorber are provided, and thereby discharges some of the liquid inside the sub-tank;

a liquid replenisher that replenishes the liquid into the sub-tank at a side of the absorber to which the compression force is applied; and a press operator that operates the presser to compress the absorber when the liquid is replenished into the sub-tank by the liquid replenisher, such that the discharged liquid from the absorber and the newly replenished liquid are reliably mixed;

wherein the liquid replenisher comprises:

at least one replenishment tank that stores the liquid to be replenished; and an actuator that moves the replenishment tank toward the sub-tank from a predetermined position so as to connect the replenishment tank and the sub-tank; and wherein the press operator operates the presser by movement of the replenishment tank.

2. The droplet ejection apparatus as set forth in claim 1;

wherein the presser comprises:

a pressing portion that contacts with the absorber so as to apply pressing force onto the absorber; and a transmission portion that moves the pressing portion according to the movement of the replenishment tank; and wherein the pressing portion is provided with a plurality of communication holes through which the liquid can flow.

3. The droplet ejection apparatus as set forth in claim 2;

wherein the replenishment tank is provided with a pressing force providing portion that contacts with the presser and provides the pressing force to the transmission portion; and wherein the pressing operator is constituted with the pressing force providing portion.

4. The droplet ejection apparatus as set forth in claim 1;

wherein the liquid replenishes comprises a plurality of replenishment tanks, wherein number of sub-tanks is larger than number of the plurality of the replenishment tanks;

wherein each of the plurality of replenishment tanks stores a different type of basic liquid; and wherein the droplet ejection apparatus comprises a mixer/supplier that supplies the plurality types of the basic liquids into at least one of plurality of sub-tanks.

5. An inkjet recording apparatus comprising the droplet ejection apparatus as set forth in claim 1;

wherein the droplet ejection apparatus ejects ink onto a recording medium.

* * * * *